US006224481B1

(12) United States Patent
McCabe

(10) Patent No.: US 6,224,481 B1
(45) Date of Patent: May 1, 2001

(54) POWER MODULATING LEAD SCREW ACTUATED BUTTERFLY BLADE ACTION DAMPER

(76) Inventor: Francis J. McCabe, #6 Bunker Hill Rd., Ottsville, PA (US) 18942

( * ) Notice: Subject to any disclaimer, the term of this patent is extended or adjusted under 35 U.S.C. 154(b) by 0 days.

(21) Appl. No.: 09/379,032

(22) Filed: Aug. 23, 1999

(51) Int. Cl.[7] ..... A62C 2/12
(52) U.S. Cl. ..... 454/369
(58) Field of Search ..... 454/369, 342, 454/354, 357

(56) References Cited

U.S. PATENT DOCUMENTS

| | | | | |
|---|---|---|---|---|
| Re. 32,362 | * | 2/1987 | McCabe | 137/15 |
| 4,545,363 | * | 10/1985 | Barchechat et al. | 126/285 B |
| 4,559,867 | * | 12/1985 | Van Becelaere et al. | 454/369 |
| 4,818,970 | * | 4/1989 | Natale et al. | 340/539 |
| 4,993,313 | * | 2/1991 | Newman et al. | 454/369 |
| 5,533,929 | * | 7/1996 | Attridge, Jr. | 454/369 |
| 5,728,001 | * | 3/1998 | Attridge, Jr. | 454/369 |

* cited by examiner

*Primary Examiner*—Harold Joyce
*Assistant Examiner*—Derek S. Boles
(74) *Attorney, Agent, or Firm*—Frank J. Benasutti

(57) ABSTRACT

A powered damper assembly in which closure of the damper blades is controlled by a powered actuator which can be powered by a pneumatic drive, an electric motor drive, or other suitable power source. The powered actuator moves a drive shaft attached to the damper blades which causes the damper blades to cycle between an open position and a closed position. The actuator can be controlled by sensors in a remote location, which allows the damper to be modulate it to set up pressure differentials and to be closed well in advance of oncoming smoke, fire, or other detected toxic fumes. The powered actuator maintains pressure on the damper blades to seal the damper tightly and prevent both smoke and fire from easily penetrating the damper. Optional remote placement of the sensors allow the damper be closed well in advance of the arrival of smoke, fumes, fire, etc. The remote sensors communicate with the dampers via direct wiring or, alternatively, via wireless transmission.

25 Claims, 11 Drawing Sheets

POWER MODULATING LEAD SCREW ACTUATED BUTTERFLY BLADE ACTION DAMPER

BACKGROUND OF THE INVENTION

1. Technical Field

This invention relates to air/smoke/fire dampers. In particular, it relates to dampers which can be controlled to be set and reset (i.e., closed and opened) locally or remotely under power, and which seal the damper under pressure when the damper blades are in the closed position, and which can modulate pressure levels to prevent smoke migration into designated non-smoking safety zones. It is also capable of setting normal operating building pressure differentials for cleaner air environments.

2. Background Art

Non-butterfly type dampers which can be closed automatically upon actuation by a heat-sensitive or other device are well-known in the art. Some such non-butterfly type dampers snap closed under either their own weight (i.e., gravity), or by mechanical force provided by springs.

As the art developed, external controls were devised to activate these dampers. Further, controls were also developed to cause the damper to be reset, that is, to be open in a ready position for heat responsive actuation in the event of fire or smoke conditions. A disadvantage of these prior art dampers is that they typically are activated by a separate device's exposure to the heat from a fire. As a result, they may disable the drive linkage making reactivation. Therefore, a substantial amount of smoke and even flames may pass through the damper before it is activated. It would be advantageous to have a damper system that could be activated well in advance of the fire or smoke to more effectively prevent either from passing through the damper.

An additional disadvantage associated with prior art systems is that these gravity or spring driven devices are slow to actuate. As a result, by the time the dampers are closed, substantial amounts of smoke, beat and even flames may have passed the damper and spread through the building.

In addition to problems caused by slow heat responsive closure, dampers which are then closed by gravity or spring driven devices do not always form an effective seal. As a result, even though the damper may be in the closed position, smoke and flames may penetrate the damper and spread to other parts of the building, causing property damage and personal injury. It would be desirable to have dampers that form an effective seal rather than merely temporarily contain either the fire or the progress of smoke, and to do so instantly, such that the potential damage from smoke, heat and flames is reduced.

While addressing the basic desirability of using dampers, the prior art has failed to provide a damper which can be powered closed well before advancing smoke and fire arrives, which creates an effective seal, and which can be sealed rapidly by a powered drive mechanism.

SUMMARY OF THE INVENTION

A powered damper assembly in which operation of the damper blades is controlled by a powered actuator. The powered actuator can be powered by a pneumatic drive, a electric owner controlled drive, or any other suitable power source. In one embodiment, the powered actuator is attached to the damper blades via a rotating shaft which is rotated by the powered actuator and which causes cycling of the damper blades to move between the open and the closed position, and be set in intermediate positions to set up controlled pressure environments by modulating the air flows. In another preferred embodiment, an electric motor powered actuator drives the shaft to cycle the damper blades between the open and the closed position. In another embodiment, the actuator can be self-controlled by a heat responsive device, which allows the damper to be closed by a spring or an automatically resetting motor control. The remote control system can communicate with the damper controls via a hard wired connection, or alternatively, via radio transmission. The powered actuation provides sufficient force to operate against heated air flow and to seal the damper tightly which in turn prevents both the smoke and fire from easily penetrating the damper. The butterfly blade design lends itself more readily to round or oval duct configurations, and this operating mechanism was developed to suit the "butterfly" damper design. The butterfly design also (when properly positioned) automatically uses the air fan or fire pressure to enhance the seal by pressing the ends of the pivoted blades against the frame.

DESCRIPTION OF THE PREFERRED EMBODIMENTS

Figure 1:
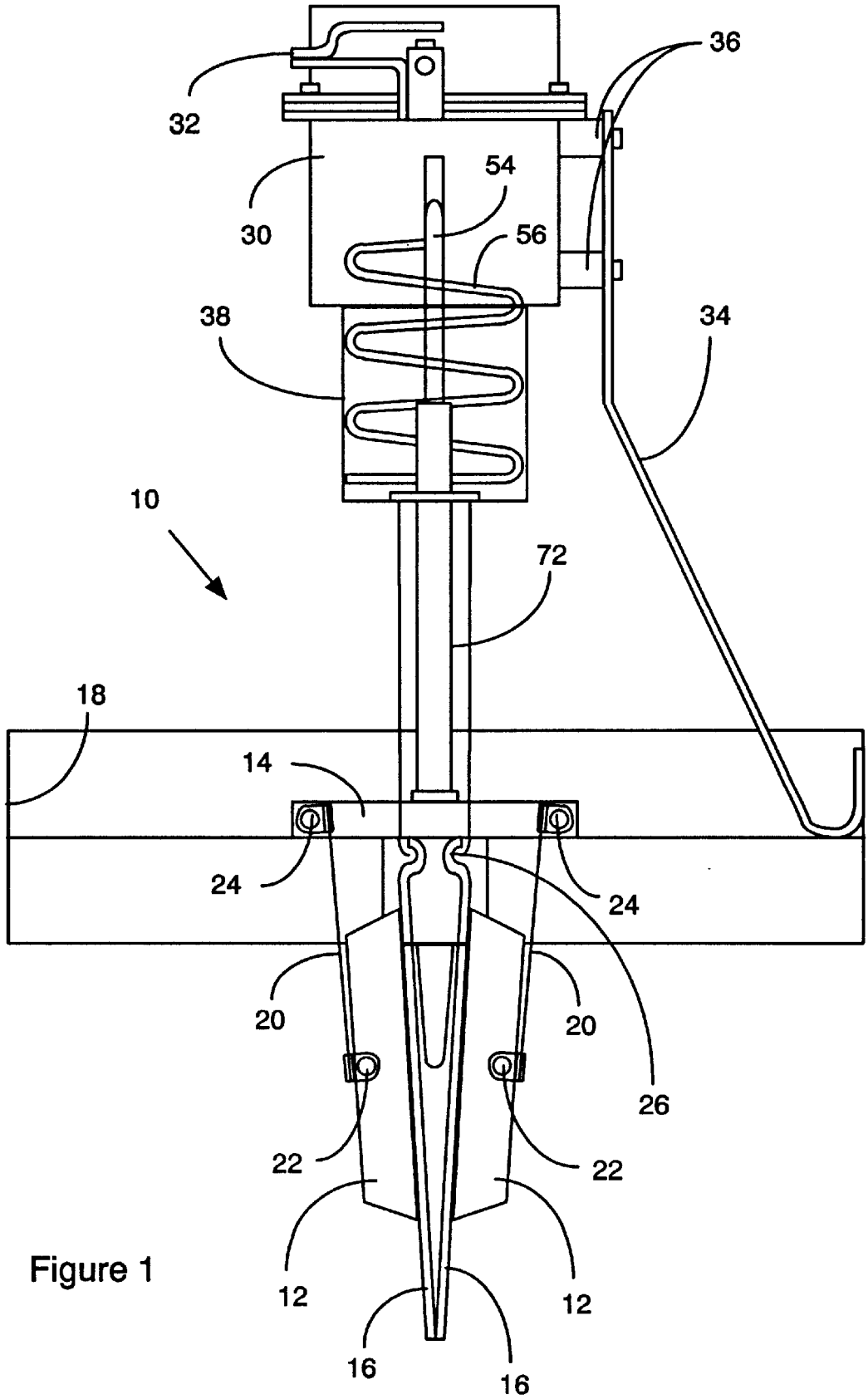
FIG. 1 is a cutaway side view of a preferred embodiment that shows a damper assembly with a pneumatic actuator in the open position.

FIG. 1 is a cutaway side view that shows a butterfly-type damper 10 of a type well known in the art, and which is used in conjunction with a powered actuator 30. Such dampers 10 normally have two blades 16 which are shown in the open position. The blades 16 permit air to pass through damper 10 with minimal obstruction. Also shown in this view are blade stiffeners 12 which are attached to blades 16 and provide strengthening and rigidity to the structure of blades 16. A principal advantage of the blade stiffeners 12 is that the rigidity and stability they add to the blades 16 provides a more consistent and secure seal when the blades 16 are moved to the sealed position.

Those skilled in the art will recognize that any suitable means can be used to secure the blade stiffeners 12 to the blades 16. For example, they can be welded, riveted, screwed, etc. Further, the blades 16 and blade stiffeners 12 are angled in relation to one another, but they do not have to be set in any particular angle. In addition, any suitable material can be used to fabricate the blades 16 and the blade stiffeners 12. The only requirement is that the material selected will perform satisfactorily in fire or smoke conditions. For ease of illustration, only two blades 16 are shown. However, those skilled on the art will recognize that the number of blades 16 can vary.

Also shown attached to the damper 10 is a powered actuator 30. In this embodiment, the powered actuator 30 is a pneumatic actuator. Pneumatic drives are well known and have been used for a variety of devices. For example, pneumatic drives have been used to control radar antennas, power tools, etc. Powered actuator 30 is secured to the damper 10 structure by a side brace 34 which is fixedly attached at one end to the frame 18 of the damper 10 and fixedly attached at the other end to mounting blocks 36 on the powered actuator 30. Between the powered actuator 30 and the damper 10, there is an actuator support bracket 38 to help maintain the relative position between the powered actuator 30 and the damper 10. The support bracket 38 also retains a shaft guide 54 which is used to guide a shaft 72 connected to the powered actuator 30. Mounted to this shaft 72 is an angled bracket 14 which is either threaded thereto or has nuts fastened thereto and threaded in mating connection with shaft 72. When the shaft 72 is rotated, the angled bracket 14 is moved axially thereon such that damper blades 16 pivot on pivot points 22, 24 and 26. When the blades 16 pivot in this manner, they are moved from the open to the closed position.

Fixedly mounted to both the actuator bracket 14 and the support brackets 12 are members 20 which are connected at pivot points 22, 24. If the shaft 72 is rotated in one direction, the actuator bracket 14 moves vertically upward, thereby exerting a force on the members 20 to move the blades 16 from the open position shown in FIG. 1 to the closed position shown below in regard to FIG. 2. Likewise, when the shaft 72 is rotated in the opposite direction, the actuator bracket 14 moves downward, resulting in a force on the members 20 which moves the blades 16 from the closed position to the open position. Those skilled in the art will recognize that either a manual or automatic switch (not shown) may be used to open the damper 10 after it has been closed.

The preferred embodiments disclosed herein use a rotating shaft 72 in combination with an angled bracket 14 to control movement of the damper blades 16. However, those skilled in the art will recognize that alternative drive mechanisms can be used to translate energy from the power actuator 30 to damper blade 16 motion.

The powered actuator 30 may be controlled by a heat responsive switch 32, such as a conventional bi-metallic device, which is well known in the art, or any other suitable switch type. It may also be controlled by remote sensors, by manual activation, or by a computerized alarm system. Those skilled in the art will recognize that when remote activation is used, the damper 10 may be closed well in advance of the arrival of the fire or smoke. This provides significant advantages in terms of damage control by reducing the possibility that smoke or fire may penetrate the damper 10 before it is closed. More importantly, it may dramatically increase the safety of the people occupying the building because it will reduce the danger of smoke inhalation. Activation based on heat responsive devices may be preset to activate over a wide range of temperatures. For example, activation may be set from a low of 150 degrees Fahrenheit to as much as 400 degrees Fahrenheit.

Figure 2:
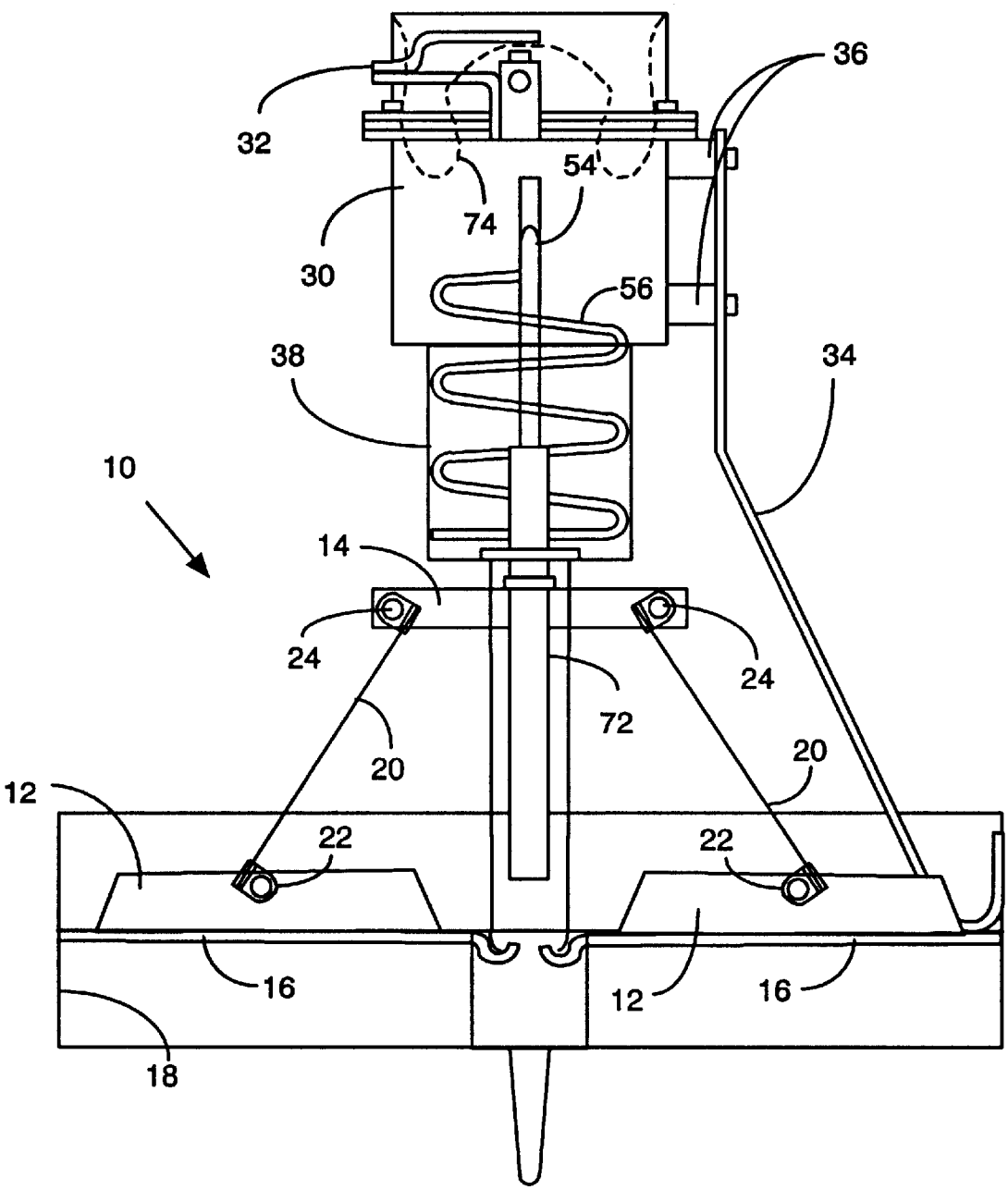
FIG. 2 is a cutaway side view of the preferred embodiment of FIG. 1 that shows the damper assembly in the closed position.

FIG. 2 is a cutaway side view that illustrates the preferred embodiment of FIG. 1 with the damper blades 16 in the closed position. In this embodiment, when the powered actuator 30 is triggered, a valve (not shown) is opened and the damper 10 moves to a closed position under pressure provided by spring 56. As can be seen, the force supplied through the powered actuator 30 forcibly presses the damper blades 16 against the damper frame 18 and holds the blades 16 in-place against any pressure build-up or differential pressure caused by fire, smoke, etc. In prior art systems, the gravity pressure provided by the systems may fail due to the buildup of pressure. This failure would result in the release of smoke or fire through the damper 10 and ultimately result in more extensive damage or injury to occupants of the building. As a result, powered closure of the damper blades 16 provides a more secure seal. Further, it allows the damper 10 to be closed from a remote location which allows earlier closure of the damper blades 16 well before arrival of smoke or fire.

Those skilled in the art will recognize that alternative methods of using pneumatic pressure can be used to close and seal the damper 10. For example, spring 54 can be used to open damper 10 and damper 10 can be closed by pneumatic pressure controlled by a valve. A pneumatic system may use a pneumatic bellows 74 to drive the damper 10 to the desired open, closed, or intermediate position. The advantage of using the mechanical pressure of the spring to seal the damper 10 is that the mechanical pressure provided by the spring is less exposed to failure than a pneumatic system which may ultimately be damaged by fire and result in the opening of the damper 10.

Figure 3:
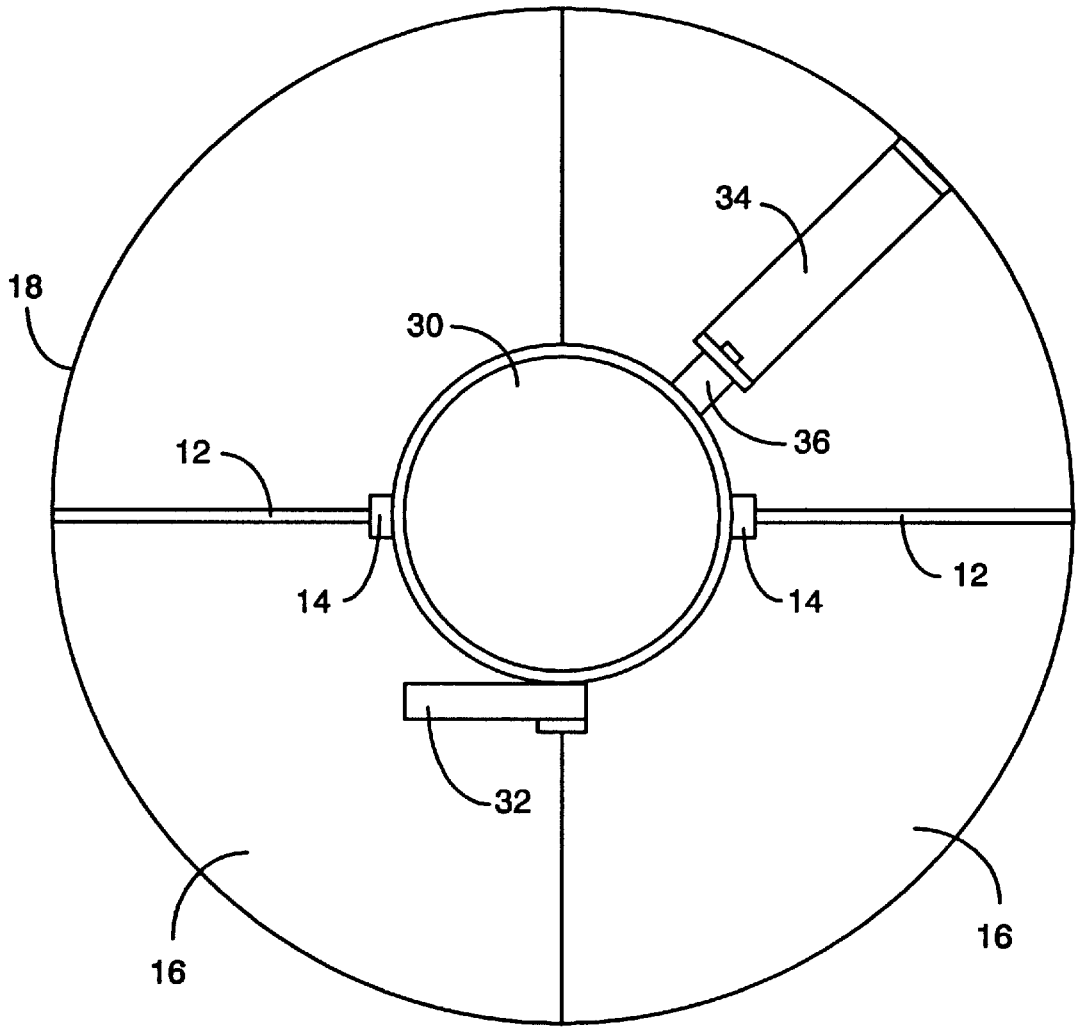
FIG. 3 is a top plan view of the preferred embodiment of FIG. 1 showing the damper assembly in the closed position.

In FIG. 3, a top plan view is shown that illustrates the preferred embodiment of FIG. 1 with the blades 16 in the closed position. Blades stiffeners 12 are shown attached to the surface of blades 16. As noted above, blades stiffeners 12 can be secured to blades 16 in any suitable manner. For ease of illustration, blades stiffeners 12 are shown aligned with actuator bracket 14. However, though skilled in the art will recognize that actuator bracket 14 does not have to be aligned with blades stiffeners 12. Further, only one blade stiffener 12 is shown attached to each damper blade 16. However, the number of blade stiffeners 12 can vary. In this view, side brace 34 is shown attached to damper frame 18 and to the powered actuator 30 via mounting blocks 36.

The damper 10 can also be automatically reset to the open position once temperatures have declined to an acceptable level. In the case of a damper 10 which is actuated by pneumatic pressure, an air input line controlled by the reset circuitry would be used to restore the pneumatic pressure.

Figure 4:
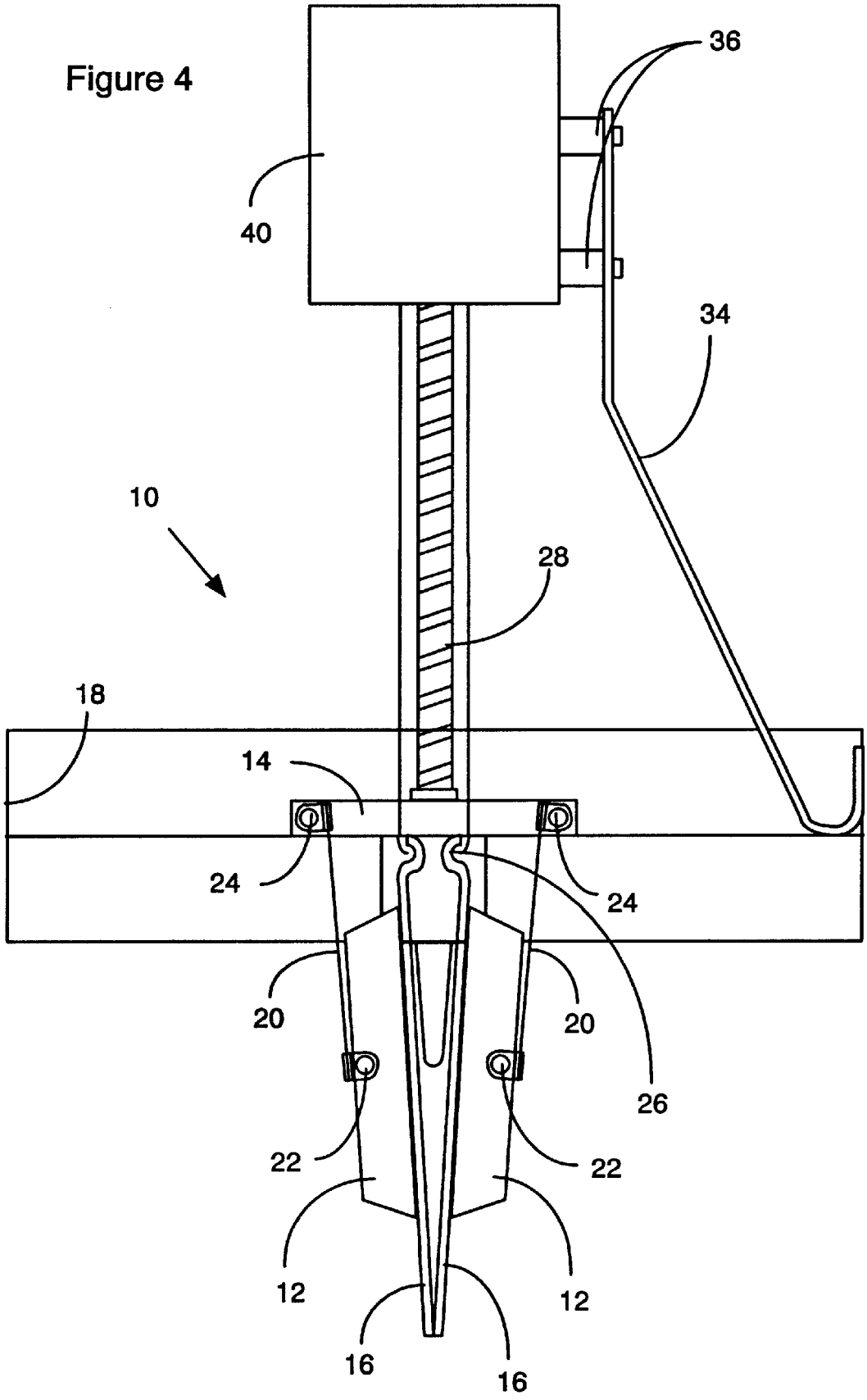
FIG. 4 is a cutaway side view of an alternative preferred embodiment that shows a damper assembly in the open position with an electric motor powered actuator.

In FIG. 4, a side cutaway view of an alternative preferred embodiment is shown. In this embodiment, the powered actuator uses electric motor 40 in place of the pneumatic actuator 30 which was used in the previous embodiment. Electric motor 40 is preferably a stepper motor which allows more precise position control of the damper blades 16. Those skilled in the art will recognize that an air motor drive can be substituted for the electrical motor 40.

When stepper motor 40 is activated, it rotates threaded shaft 28 which in turn moves angled bracket 14 which then moves damper blades 16 from an open to a closed position, or vice versa. In addition, the stepper motor 40 may be used to partially open or close the damper blades 16. This is an advantage over the pneumatic actuator in that when the damper 10 is partially opened or closed under precision control of the stepper motor 40, the air flow can be automatically controlled. In large buildings, the central computer can use remote sensors to regulate air flow throughout the building by independently controlling each damper 10.

Stepper motor 40 may be attached to the damper frame 18 in the same manner that the pneumatic drive 30 of the previous embodiment was attached to damper frame 18. The damper frame 18, damper blades 16, angled bracket 14, and rotating shaft 28 do not need to be altered to use the stepper motor 40 of this embodiment.

Figure 5:
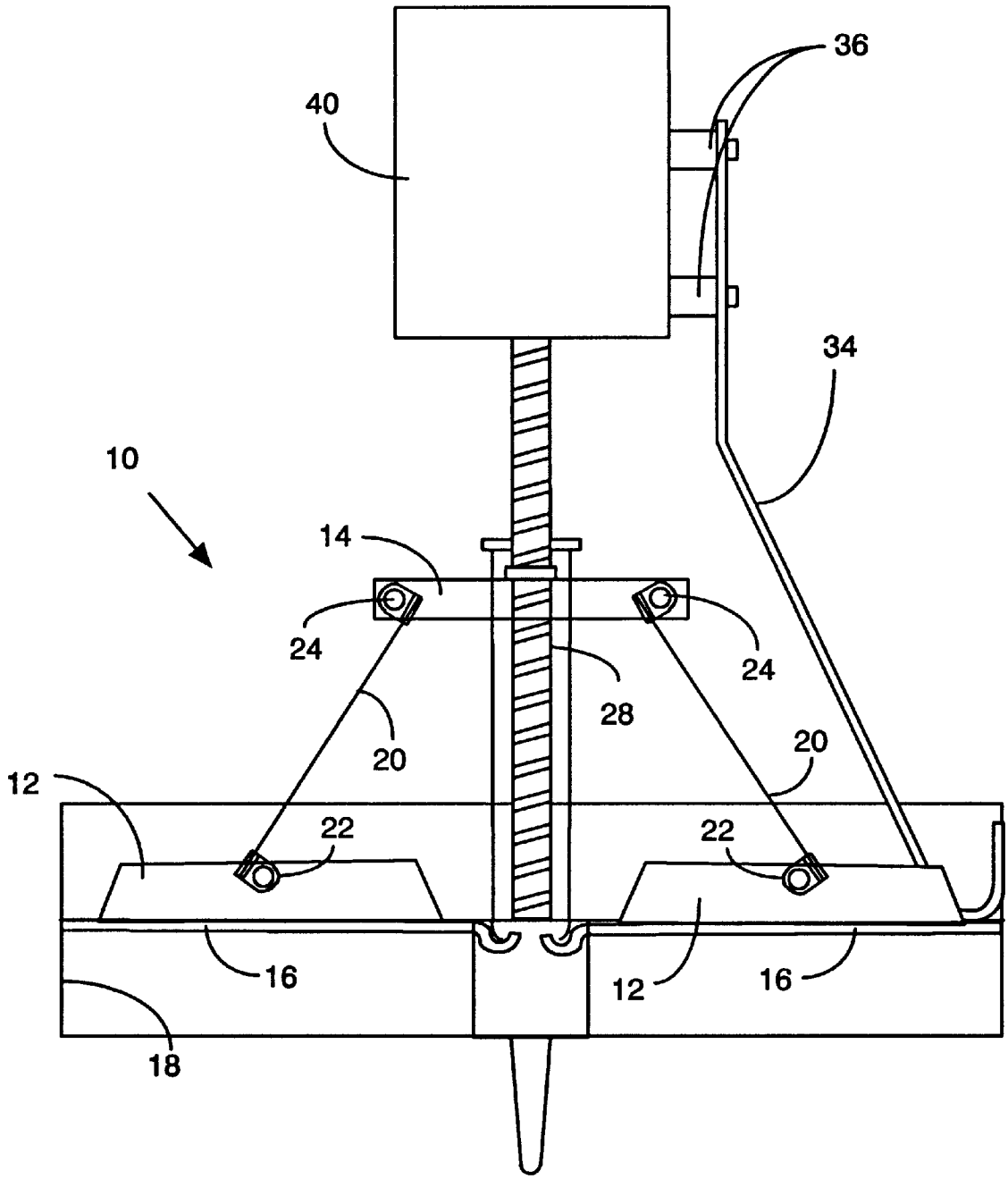
FIG. 5 is a cutaway side view of the preferred embodiment of FIG. 4 that shows the damper assembly in the closed position.

In FIG. 5, a cutaway side view of the preferred embodiment of FIG. 4 shown with the damper blades 16 in the closed position. The stepper motor 40 has rotated threaded shaft 28 which in turn has raised angled bracket 14. When angle bracket 14 is raised, members 20, which are connected to angle bracket 14 at pivot points 24 and connected to damper blades 16 at pivot points 22, pull damper blades 16 upward into the closed position.

Figure 6:
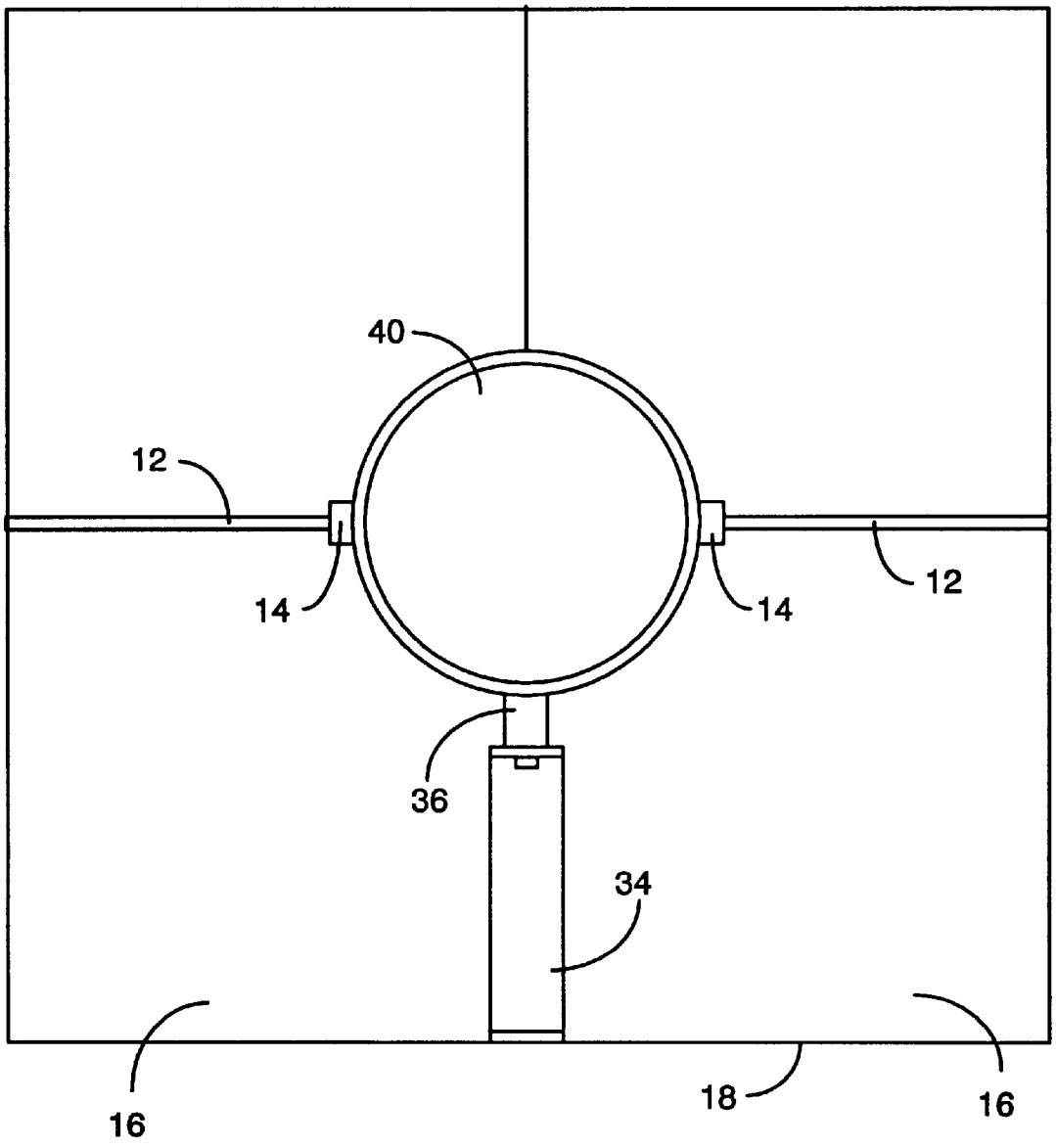
FIG. 6 is a top plan view of the preferred embodiment of FIG. 4 showing the damper assembly in the closed position period.

FIG. 6 is a top plan view of the preferred embodiment of FIG. 4. For ease of illustration, only two damper blades 16 are shown, and each damper blade 16 has only a single blade stiffener 12. However, those skilled in the art will recognize that any convenient number of damper blades 16 can be used. In addition, the number of blade stiffeners 12 can also vary based on the size of the damper blades 16 and the strength of the material used to make them. As was the case with the previous embodiment, the angled bracket 14 does not have to be aligned with a blade stiffener 12. The members 20 (not shown in his figure) can in fact be attached to blade stiffeners 12 or attached directly to the damper blades 16.

The damper blades 16 may vary in size. As a practical matter, commercially available dampers typically have damper blade 16 sizes which vary from 16 to 24 inches. The two previous embodiments also show various details which are not critical to implementation of the invention. For example, members 20 are shown attached to rotatable pivot points 22 and 24. However, a variety of attachment means can be used to secure members 20 to angle bracket 14, to the damper blades 16 or to the blade stiffeners 12. The preferred embodiments discussed so far illustrate a damper 10 with only two damper blades 16. Those skilled in the art will recognize that any convenient number of damper blades 16 can be used.

Another aspect of the invention which is not critical to its implementation is the shape of the damper 10. In the embodiment of FIG. 1, the damper 10 was illustrated as having a generally circular shape. In the embodiment of FIG. 4, the damper 10 was illustrated as having a generally rectangular shape. Control of the damper blades 16 is not dependent on the shape of the damper 10 which may be made in any convenient size or shape.

Figure 7A:
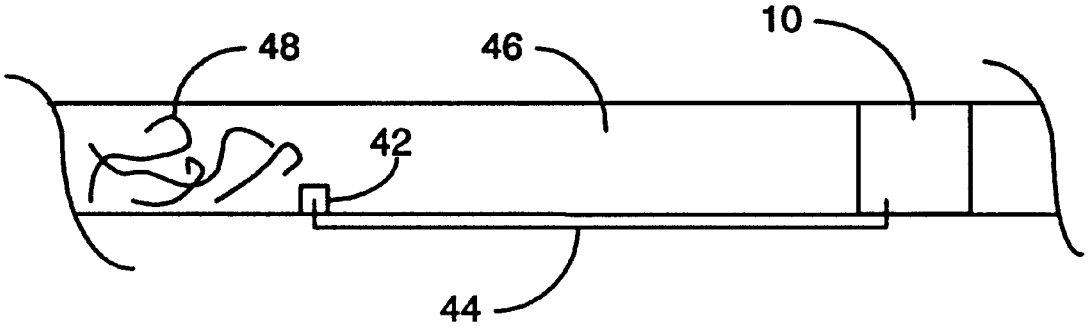
FIG. 7A illustrates an alternative preferred embodiment in which a remote sensor in an air duct controls a powered damper via hard wired lines.
Figure 7B:
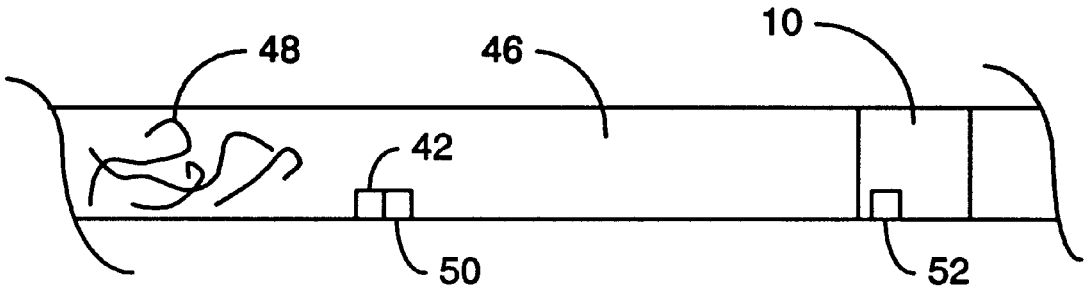
FIG. 7B illustrates another alternative preferred embodiment in which a remote sensor in an air duct controls a powered damper via radio communication.

FIGS. 7A and 7B illustrate other preferred embodiments of the invention which remotely control operation of the powered damper 10. In FIG. 7A, a remote sensor 42 is attached to damper 10 via hard wiring 44. When remote sensor 42 detects heat or smoke 48, it signals the power actuator 30 or 40 in damper 10 via wires 44. Damper 10 then closes to prevent smoke 48 or fire from passing through damper 10. By locating sensor 42 at a distance from damper 10, damper 10 can close well in advance of the arrival of the smoke 48 or the fire. The ability to quickly close damper 10 before smoke on fire has passed through it is a significant advantage to the occupants of the building, because most personal injuries, and most deaths, are caused by smoke inhalation and not by the fire itself.

FIG. 7B illustrates another preferred embodiment of the invention. In this embodiment, the remote sensor 42 includes a radio transmitter 50. When the sensor 42 detects smoke 48 or fire, it signals a receiver 52 which is attached to the damper 10. The receiver 52 notifies power actuator 30 or 40 (depending on the embodiment) which turn closes the damper 10. Those skilled in the art will recognize that while the term radio is used, any suitable wireless communications technology may be used to implement this function. This embodiment eliminates the signal wire 44. This can be important because, depending on the location of a fire, the wiring may be damaged by fire before the remote sensor 42 detects the smoke 48 or fire.

All the previous embodiments discussed control of the dampers 10 by powered actuators 30 or 40 for use in fire control situations. Those skilled in the art will recognize that there are other reasons to control closure of dampers 10. For example, in manufacturing environments workers may be exposed to toxic fumes from a wide variety of sources. Specialized sensors of any type may be used in the manner described previously to protect workers or occupants of building from dangerous fumes which may have nothing to do with fire. In the case of toxic fumes, early detection of the fumes, along with rapid and secure closure of the dampers 10, can be extremely important in terms of safety.

In addition, all of the dampers 10 in a given location may be controlled by a central computerized system (not shown) that may use a variety of sensor types including fire, smoke, toxic fumes, vibration (e.g. for use an earthquake prone areas), etc. In addition to centrally controlling the dampers 10 in emergency situations, a central computer can also be used to control damper 10 operation for the purpose of regulating ventilation in a building during normal use. The embodiment which uses a stepper motor 40 is particularly useful for this activity since it allows for precision control of the damper blades 16.

FIGS. 7A–B illustrate the damper 10 installed in a horizontally oriented duct 46. However, the damper 10 can just as easily be installed in a vertically oriented duct 46, or one that is oriented in a variety of directions. This provides an advantage over gravity powered or spring powered dampers in that the orientation of the damper does not affect its performance.

Figure 8:
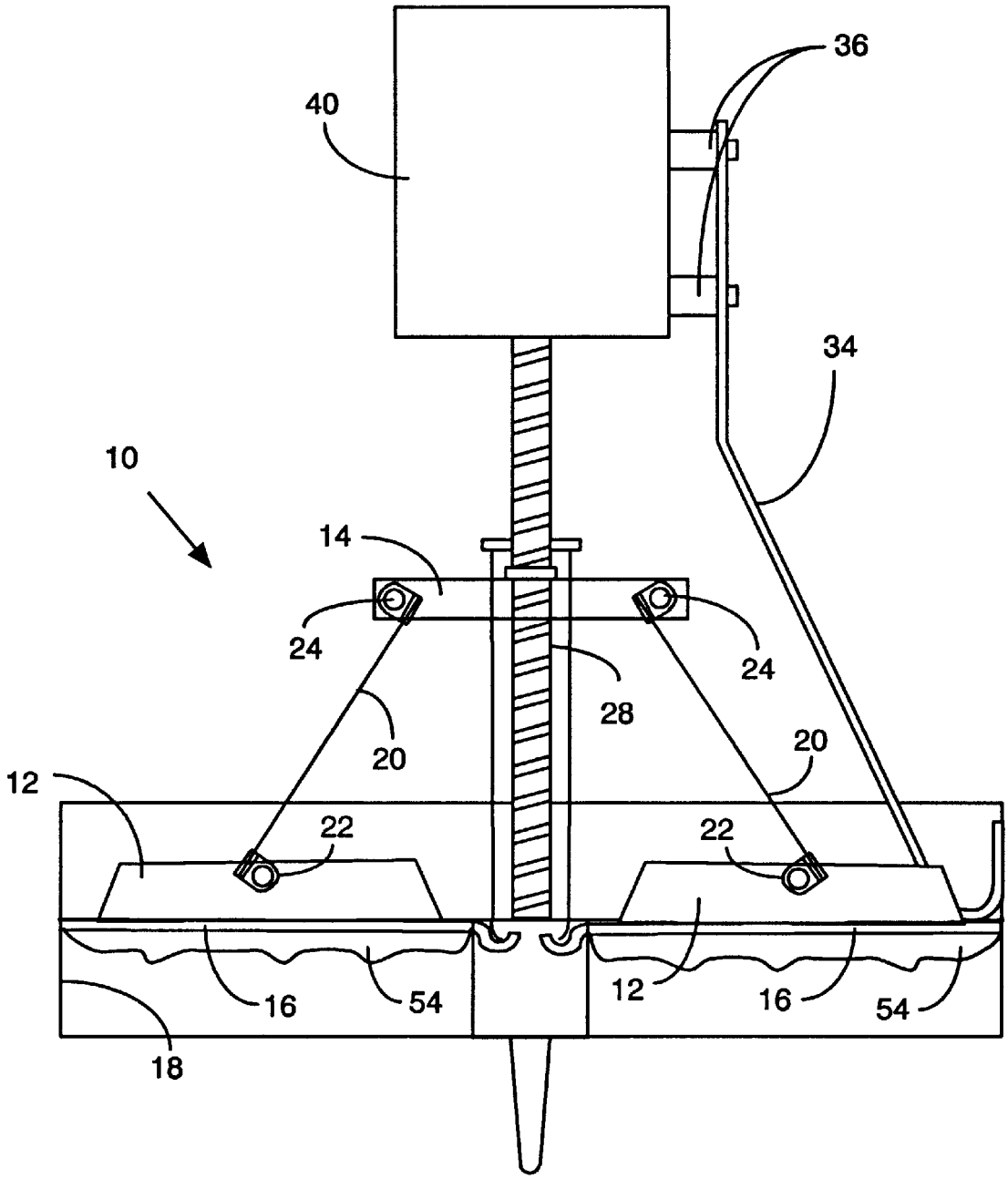
FIG. 8 illustrates another alternative preferred embodiment in which an optional radiation blanket is installed on the surface of the damper blades.

In FIG. 8, an optional radiation blanket 54 is illustrated. The radiation blanket 54 is attached to the surface of the damper blades 16. The radiation blanket 54 insulates the damper blades 16 from heat and helps to prevent deformity of the damper blades 16. The radiation blanket 54 can be fabricated from any suitable material which is resistant to the high temperatures found in a fire condition.

Figure 9A:
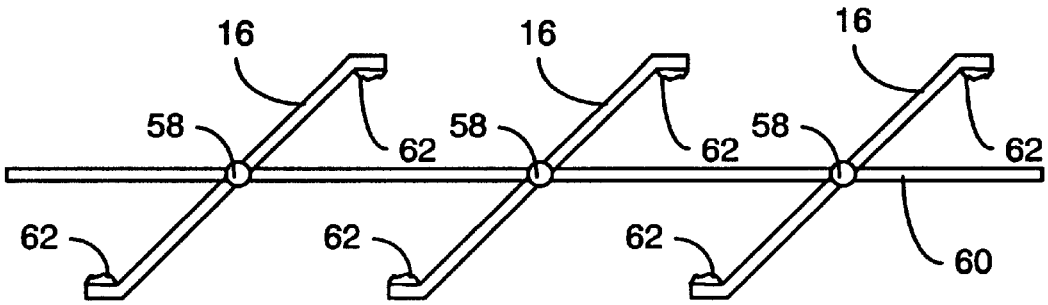
FIG. 9A illustrates an alternative embodiment in which the edges of the damper blades are treated with a heat resistant sealant to provide a more effective seal. In this figure, the damper blades are shown in the open position.

FIG. 9A illustrates an alternative preferred embodiment in which the edges of damper blades 16 have a layer of heat resistant sealant 62. For ease of illustration, multiple adjacent damper blades 16 are shown. Each damper blade 16 is attached at a pivot point 58, which is in turn attached to damper frame 18 along pivot point attachment line 60. In this figure, the damper blades 16 are shown in the open position. Any suitable material can be used for the heat resistant sealant. However, in the preferred embodiment a commercially available silicone based sealant is used.

Figure 9B:
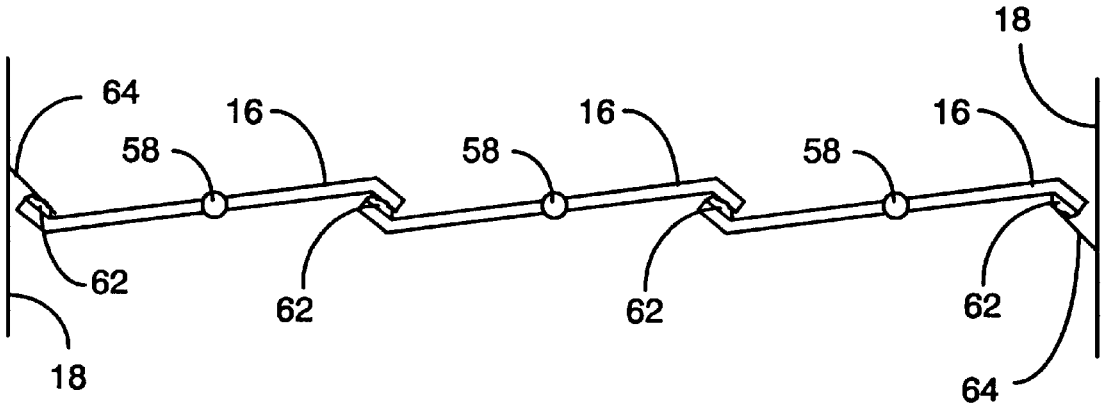
FIG. 9B illustrates the embodiment of FIG. 9A with the damper blades in the closed position.

In FIG. 9B, the preferred embodiment of FIG. 9A is shown with the damper blades 16 in the closed position. For ease of illustration, pivot point attachment line 60 is not shown in this figure. When the damper blades 16 are rotated to the closed position, the heat resistant sealant 62 on adjacent damper blades 16 come in contact and form an improved seal to prevent smoke or heated air from passing through the damper 10. Also shown in this figure is a segment of damper frame 18. Attached to damper frame 18 is a surface 64 against which damper blades 16 can seal. Surface 64 is shown for illustrative purposes only. Those skilled of the art will recognize that surface 64 can be eliminated if damper blade 16 is constructed such that it seals directly against the wall of damper frame 18.

Figure 10:
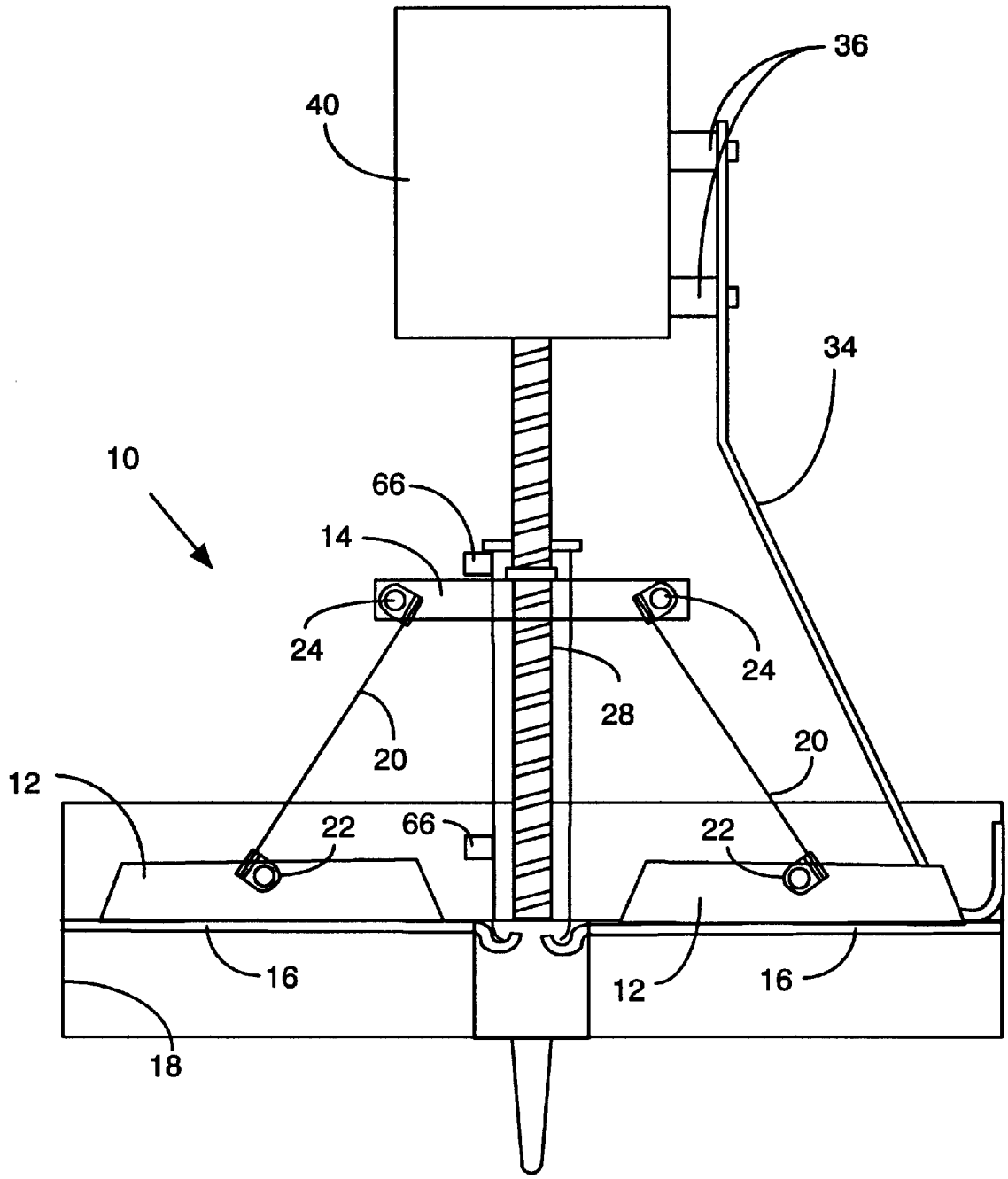
FIG. 10 illustrates an alternative preferred embodiment in which travel limit switches are placed on the actuator to automatically shut off the actuator at preset damper travel limits.

FIG. 10 is a side view that illustrates an alternative preferred embodiment in which travel limit switches 66 are used to prevent the actuator 40 from attempting to move the damper blades 16 beyond preset damper blade travel limits. Travel limit switches 66 prevent damage to the damper blades 16 which may have otherwise occurred if the actuator 40 erroneously attempted to force the damper blades 16 beyond their intended travel limits. The travel limit switches 66 are electrically connected to the actuator 40 controls in the preferred embodiment. However, those skilled in the art will recognize that a variety of methods can be used to implement this switching system.

Figure 11:
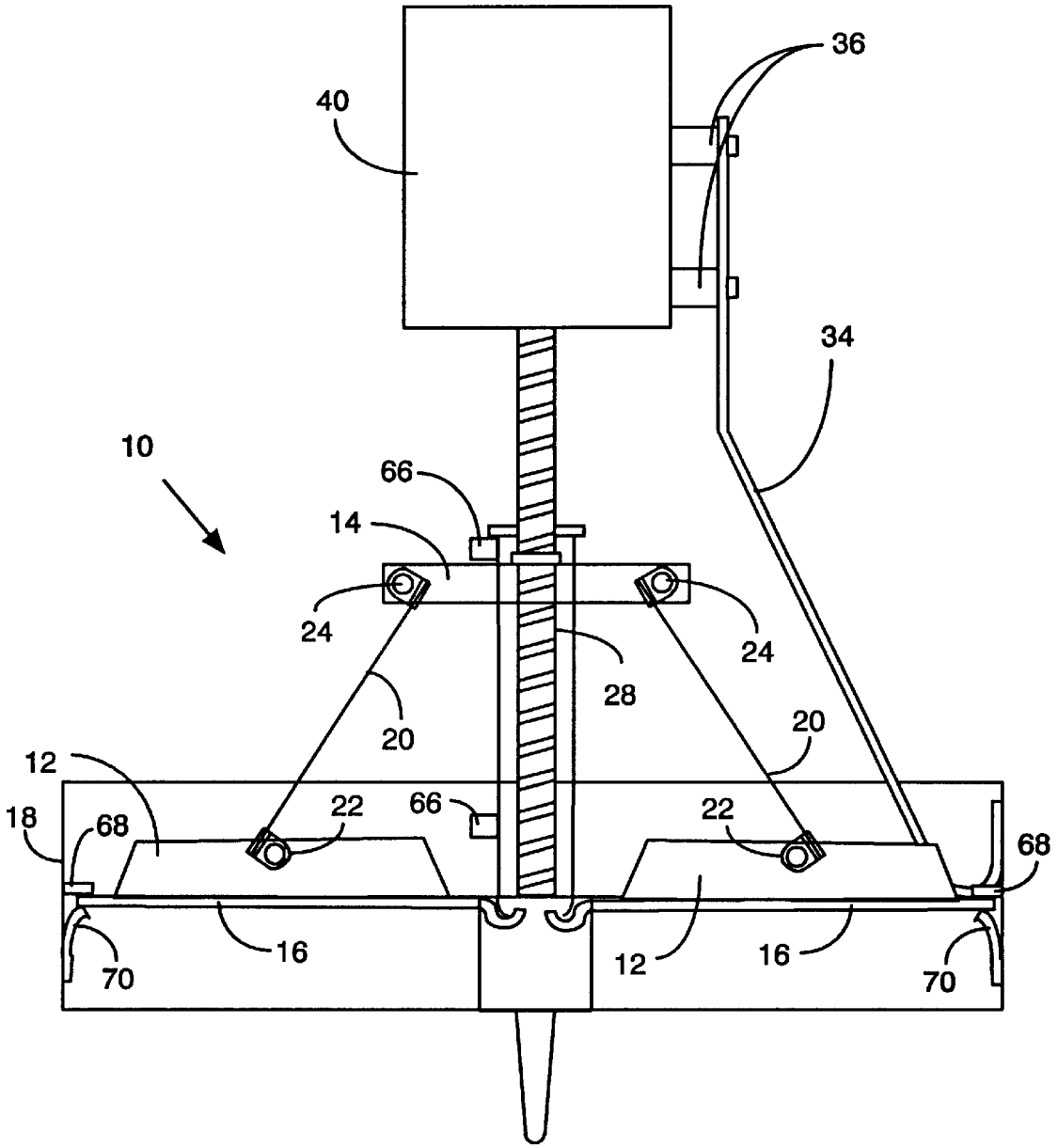
FIG. 11 illustrates another preferred embodiment in which a thermal locking mechanism is used to prevent the damper blades from being open in high temperature conditions.

FIG. 11 illustrates another alternative embodiment in which a thermal locking mechanism is used to prevent the damper 10 from opening in high temperature conditions. This figure is a side cutaway view showing the damper blades 16 in the closed position. Damper blades 16 are shown pressed against damper blade stops 68. The damper blades 16 are locked in the closed position by a thermal lock 70. In the preferred embodiment, thermal lock 70 is fabricated from a bi-metallic strip that is attached to damper frame 18. In low temperatures, thermal lock 70 rests flat against the wall of damper frame 18, and damper blades 16 are free to open and close without interference from thermal lock 70. However, in high temperature conditions the damper blades 16 will be closed by actuator 40 and press against damper blade stops 68. As the temperature increases, thermal lock 70 bends due to the different expansion rates in metals used to form the bi-metallic strip. Once heated, the bi-metallic strip extends outward into the travel path of damper blades 16 and prevents them from moving back to the open position.

An advantage using thermal lock 70 is that it provides an extra measure of protection by ensuring that the damper 10 cannot open in high temperature conditions.

While the invention has been described with respect to a preferred embodiment thereof, it will be understood by those skilled in the art that various changes in detail may be made therein without departing from the spirit, scope, and teaching of the invention. For example, the material used to fabricate the damper may be anything suitable for the intended use in conditions of potential fire, smoke, or toxic fumes. The size and shape of the damper may also vary. The number of blades may vary in size, shape or orientation. The rotating shaft 28 may be exchanged with other suitable blade drive devices.

Novelties:

1. Powered butterfly.
2. Round, oval or rectangular configuration.
3. Two direction lead screw turning that holds the damper in open, closed or intermediate positions for pressure setting when lead screw stops. No spring or other locking means needed.
4. Heat responsive drive to closed or opened position by thermal switch.
5. An easily adjustable mechanism to set power and stroke for various size dampers.
6. Computer drive compatible D.C. electric motor.

Accordingly, the invention herein disclosed is to be limited only as specified in the following claims.

I claim:

1. A powered damper assembly, comprising:

a damper, further comprising:

a damper frame; and at least one damper blade pivotally attached to the damper frame such that it has an open position to allow air flow and a closed position to prevent air flow through the damper frame;

a power actuator cycling means attached to the damper, said powered actuator cycling means comprising a pneumatic drive assembly connected to a source of pneumatic pressure; and a movable shaft means, movably attached at one end to the powered actuator cycling means and attached at its other end to the damper blade such that the powered actuator cycling means can move the shaft means and cause the damper blade to move and cycle between an open position and a closed position a source of pneumatic pressure; means to change the level of pneumatic pressure; and opposing pressure means set in opposition to the pneumatic pressure and providing opposing pressure such that a change in the level of pneumatic pressure in relation to the opposing pressure means will result in movement of the movable shaft; whereby movement of the damper blades is selectively controlled by varying the pneumatic pressure.

2. A powered damper assembly as in claim 1, further comprising a sensor electrically connected to the powered actuator, the sensor having means to control activation of the powered actuator to control opening or closing of the damper when a sensed condition indicates that the damper should be opened or closed;

whereby the sensor controls air flow through the damper.

3. A powered damper assembly, as in claim 2, wherein the sensor is remotely located from the damper;

whereby the sensor can activate the damper before the sensed condition triggering activation of the powered actuator reaches the damper.

4. A powered damper assembly, as in claim 3, further comprising:

a wireless transmitter attached to the sensor;

means to transmit a control signal from the wireless transmitter when the sensor detects a predetermined sensed condition; and a receiver attached to the powered actuator such that when the control signal is received, the receiver signals the powered actuator to open or close the damper.

5. A powered damper assembly, as in claim 2, further comprising a computer, the computer attached to the sensor and further attached to be powered actuator such that the computer monitors sensor for sensed conditions and activates the powered actuator on a pre-selected sensed condition is detected;

whereby the computer monitors the sensors and controls operation of the dampers.

6. A powered damper assembly, as in claim 1, further comprising:

a first blade travel switch attached to the movable shaft such that it notifies the powered actuator when the movable shaft has moved the damper blades to the open position; and a second blade travel switch attached to the movable shaft such that it notifies the powered actuator when the movable shaft has moved the damper blades to the closed position.

7. A powered damper assembly, as in claim 1, further comprising a sensor electrically connected to the powered actuator, the sensor having means to control activation of the powered actuator to control opening or closing of the damper when a sensed condition indicates that the damper should be opened or closed;

whereby the sensor controls air flow through the damper.

8. A powered damper assembly, as in claim 7, wherein the sensor is remotely located from the damper;

whereby the sensor can activate the damper before the sensed condition triggering activation of the powered actuator reaches the damper.

9. A powered damper assembly, as in claim 8, further comprising:

a wireless transmitter attached to the sensor;

means to transmit a control signal from the wireless transmitter when the sensor detects a predetermined sensed condition; and a receiver attached to the powered actuator such that when the control signal is received, the receiver signals the powered actuator to open or close the damper.

10. A powered damper assembly, as in claim 7, further comprising a computer, the computer attached to the sensor and further attached to the powered actuator such that the computer monitors sensor for sensed conditions and activates the powered actuator when a pre-selected sensed condition is detected;

whereby the computer monitors the sensors and controls operation of the dampers.

11. A powered damper assembly, as in claim 1, further comprising:

a first blade travel switch attached to the movable shaft such that it notifies the powered actuator when the movable shaft has moved the damper blades to the open position; and a second blade travel switch attached to the movable shaft such that it notifies the powered actuator when the movable shaft has moved the damper blades to the closed position.

12. A powered damper assembly, as in claim 1, further comprising a radiation blanket attached to the surface of the damper blades such that when the damper blades are in the closed position, the damper blades are protected from radiated heat.

13. A powered damper assembly, as in claim 1, further comprising a thermal lock, the thermal lock attached to the damper assembly such that it does not restrict movement of the damper blades in normal operating conditions, and further attached to the damper assembly such that in high temperature conditions caused by fire, the thermal lock prevents the damper blades from moving from the closed to the open position.

14. A powered damper assembly, as in claim 1, further comprising a heat resistant seal, the heat resistant seal attached to the edges of the damper blades such that when the damper blades are closed, the heat resistant seal reduces the amount of air that can flow between the damper blades.

15. A powered damper assembly, as in claim 14, wherein the heat resistant seal is fabricated from silicone.

16. A method of controlling air flow by opening and closing damper assemblies with a powered damper actuator, including steps of:

using a damper to control flow through a conduit, including the steps of:

attaching a damper frame to the conduit; and pivotally attaching at least one damper blade to the damper frame such that it has an open position to allow air flow and a closed position in which the damper is sealed such that no air may flow through;

fixedly attaching to a pneumatic powered drive assembly actuator to the damper frame such that it is held in fixed relationship to the damper frame; and providing a source of pneumatic pressure to said pneumatic powered drive assembly actuator; movably attaching a movable shaft at one end to the powered actuator and at its other end to the damper blade such that when the movable shaft is moved, it moves the damper blade from an open position to a closed position;

whereby the damper blade may be opened and closed by the powered actuator providing a source of pneumatic pressure; changing the level of pneumatic pressure; and providing opposing pressure in opposition to the pneumatic pressure in opposition to the pneumatic pressure such that a change in the level of pneumatic pressure in relation to the opposing pressure will result in movement of the movable shaft; whereby movement of the damper blades his selectively controlled by varying the pneumatic pressure.

17. A method, as in claim 16, including the additional step of connecting a sensor to the powered actuator, the sensor having means to control activation of the powered actuator to control opening or closing of the damper when a sensed condition indicates that the damper should be opened or closed;

whereby the sensor controls air flow through the damper.

18. A method, as in claim 17, including the additional step of locating the sensor remotely from the damper;

whereby the sensor can activate the damper before the sensed condition triggering activation of the powered actuator reaches the damper.

19. A method, as in claim 18, including the additional steps of:

attaching a wireless transmitter to the sensor;

transmitting a control signal from the wireless transmitter when the sensor detects a predetermined sensed condition;

receiving the control signal with a receiver attached to the powered actuator; and signaling the powered actuator to open or close the damper when the control signal is received by the receiver.

20. A method, as in claim 17, including the additional step of using a computer attached to the sensor and further attached to be powered actuator to monitor the sensor for sensed conditions and activate the powered actuator when a pre-selected sensed condition is detected;

whereby the computer monitors the sensors and controls operation of the dampers.

21. A method, as in claim 16, including the additional steps of:

attaching a first blade travel switch to the movable shaft such that it notifies the powered actuator when the movable shaft has moved the damper blades to the open position; and attaching a second blade travel switch to the movable shaft such that it notifies the powered actuator when the movable shaft has moved the damper blades to the closed position.

22. A method, as in claim 16, including the additional step of attaching a radiation blanket to the surface of the damper blades such that when the damper blades are in the closed position, the damper blades are protected from radiated heat.

23. A method, as in claim 16, including the additional step of attaching a thermal lock to the damper assembly such that it does not restrict movement of the damper blades in normal operating conditions, and further attaching it to the damper assembly such that in high temperature conditions caused by fire, the thermal lock prevents the damper blades from moving from the closed to the open position.

24. A method, as in claim 16, including the additional step of attaching a heat resistant seal to the edges of the damper blades such that when the damper blades are closed, the heat resistant seal reduces the amount of air that can flow between the damper blades.

25. A method, as in claim 24, including the additional step of fabricating the heat resistant seal from silicone.

* * * * *

UNITED STATES PATENT AND TRADEMARK OFFICE

CERTIFICATE OF CORRECTION

PATENT NO. : 6,224,481 B1
DATED : May 1, 2001
INVENTOR(S) : Xiao-Qing Han et al.

It is certified that error appears in the above-identified patent and that said Letters Patent is hereby corrected as shown below:

Title page,
Item [73] Assignee: replace "Norhtfield, IL" with -- Northfield, IL --.

Signed and Sealed this

Twenty-ninth Day of January, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,224,481 B1
DATED : May 1, 2001
INVENTOR(S) : Francis J. McCabe et al.

It is certified that error appears in the above-identified patent and that said Letters Patent is hereby corrected as shown below:

This certificate supersedes Certificate of Correction issued January 29, 2002, the number was erroneously mentioned and should be vacated since no Certificate of Correction was granted.

Signed and Sealed this

Tenth Day of December, 2002

JAMES E. ROGAN
*Director of the United States Patent and Trademark Office*